US006293070B1

(12) United States Patent
Castaño

(10) Patent No.: US 6,293,070 B1
(45) Date of Patent: Sep. 25, 2001

(54) CLADDING FOR A DOMED STRUCTURE

(75) Inventor: Francisco Castaño, Houston, TX (US)

(73) Assignee: Geometrica, Inc., Houston, TX (US)

( * ) Notice: Subject to any disclaimer, the term of this patent is extended or adjusted under 35 U.S.C. 154(b) by 0 days.

(21) Appl. No.: 09/334,795

(22) Filed: Jun. 16, 1999

(51) Int. Cl.[7] ..... E04C 1/34
(52) U.S. Cl. ..... 52/466
(58) Field of Search ..... 52/80.1, 465, 466, 52/469

(56) References Cited

U.S. PATENT DOCUMENTS

| | | | | |
|---|---|---|---|---|
| 2,895,753 | | 7/1959 | Fentiman . | |
| 2,916,109 | | 12/1959 | Fentiman . | |
| 2,931,467 | | 4/1960 | Fentiman . | |
| 2,964,147 | | 12/1960 | Fentiman . | |
| 2,976,968 | | 3/1961 | Fentiman . | |
| 3,079,681 | | 3/1963 | Fentiman . | |
| 3,081,601 | | 3/1963 | Fentiman . | |
| 3,152,819 | | 10/1964 | Fentiman . | |
| 3,275,351 | | 9/1966 | Fentiman . | |
| 3,309,121 | | 3/1967 | Fentiman . | |
| 4,005,555 | * | 2/1977 | Roth | 52/60 |
| 4,045,928 | * | 9/1977 | Malott | 52/465 |
| 4,400,924 | * | 8/1983 | Andrews | 52/466 |
| 4,959,939 | * | 10/1990 | Buchanan | 52/466 |
| 5,152,115 | * | 10/1992 | Cotter | 52/466 |
| 5,187,911 | * | 2/1993 | Cotter | 52/469 |
| 5,272,849 | * | 12/1993 | Zahner | 52/466 |
| 5,363,624 | * | 11/1994 | Cotter | 52/466 |
| 5,867,961 | | 2/1999 | Castano . | |
| 5,974,752 | * | 11/1999 | Watson | 52/466 |

* cited by examiner

*Primary Examiner*—Beth A. Stephan
(74) *Attorney, Agent, or Firm*—Haynes and Boone, L.L.P.

(57) ABSTRACT

Cladding for a domed structure bridges gaps between adjacent roofing panels. The cladding preferably utilizes adjustable cladding panels and bridges to bridge the gap between adjacent roofing panels. The cladding is particularly suited for doubly curved surfaces.

7 Claims, 10 Drawing Sheets

CLADDING FOR A DOMED STRUCTURE

BACKGROUND

The disclosures herein relate generally to space frame structures, and in particular to cladding for domed space frame structures.

In space frame construction, a generally cylindrical hub includes a plurality of outwardly directed slots extending along the peripheral surface of the hub. The slots have opposed ribbed surfaces. Tubular frame members are flattened and crimped at their opposed ends. The crimped ends include elongated flat surfaces extending outwardly, or away from each other. The crimped ends are ribbed in a pattern which can be mated into engagement with the ribs in the hub slots. In this manner, each end of a tubular frame member may be slidably inserted into a respective hub slot and several tubular members may be connected at one end to a hub slot to form a spider, i.e., a hub having a plurality of tubes extending outwardly therefrom, each tube terminating at a free end.

The free end of each tube can be similarly connected to another hub. Thus, a framework of interconnected spiders formed of tubes and hubs can be joined to form a pre-assembled or modular section of a flat roof, a domed roof, a wall, etc., to be joined with other sections to eventually form a complete structure. The structure, once completed is then covered with a selected cladding which is attached to the structural framework by means of an interfacing cladding support system.

The cladding may be fabric, corrugated steel plates, glass, and other selected materials, and may include combinations of these materials for architectural design purposes. For example, a domed roof may be clad with steel and may include a pattern of glass panels in a portion of the roof which has an aesthetic effect when viewed from the interior of the structure.

However, in constructing domed space-frame structures having a plurality of roofing areas that include doubly curved surfaces, of positive and/or negative gaussian curvature, it is difficult to cover such surfaces with conventional rectangular cladding panels without gaps of variable width occurring between the cladding panels.

Therefore, what is needed is a cladding system for domed structures directed to overcoming one or more of the limitations of the existing structures.

SUMMARY

One embodiment, accordingly, provides a building that includes a support structure, a first panel coupled to the support structure, a second panel coupled to the support structure, wherein at least a portion of the second panel is separated from the first panel by a gap, and a bridge coupled to the support structure and the first and second panels, wherein the bridge includes: a cover, and a clip nested within the cover, wherein the cover bridges the gap.

A principal advantage of this embodiment is that it permits a domed structure to be covered in a manner which avoids the limitations presently associated with cladding such structures.

BRIEF DESCRIPTION OF THE DRAWING FIGURES

DETAILED DESCRIPTION

A cladding system for a domed structure is provided that permits gaps between adjacent roofing panels to be bridged without the use of custom made bridging panels of variable size. In a preferred embodiment, the cladding system bridges variable gaps between adjacent roofing panels positioned on a doubly curved surface. In this manner, the construction of a domed structure is simplified.

A cladding system for a domed structure is also provided that utilizes roofing overlapping roofing panels coupled by an adhesive layer. In this manner, a watertight roofing system is provided without having to utilize custom fabricated roofing panels.

Figure 1:
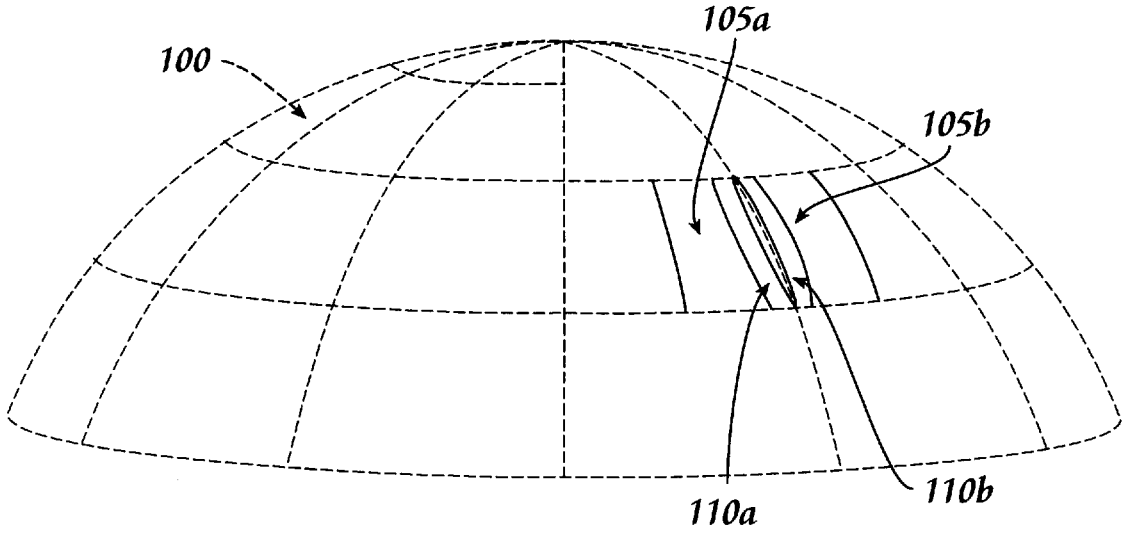
Fig. 1 (PRIOR ART)
FIG. 1 is a perspective view illustrating an embodiment a portion of the cladding for a domed structure including doubly curved surfaces.
Figure 2:
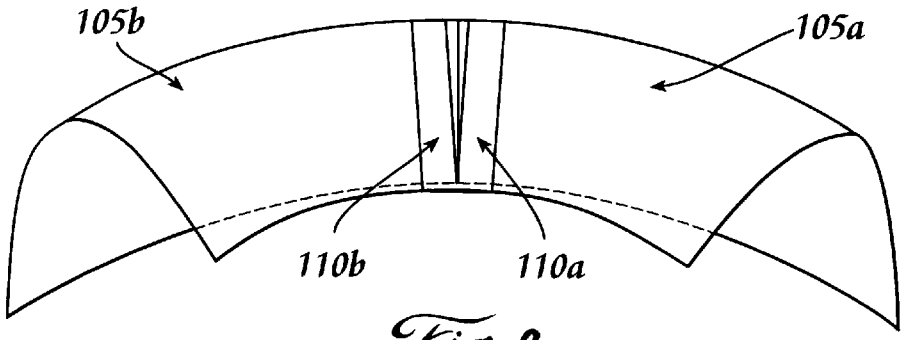
Fig. 2 (PRIOR ART)
FIG. 2 is another perspective view illustrating an embodiment of the portion of the cladding for a domed structure including doubly curved surfaces of FIG. 1.

Referring initially to FIGS. 1 and 2, a doubly curved surface 100 is illustrated that includes a number of individual sections 105*a* and 105*b*. The doubly curved surface 100 is typical of surfaces found in domed structures. The doubly curved surface 100 has positive gaussian curvature. Alternatively, the doubly curved surface 100 could have negative gaussian curvature. Therefore, persons of ordinary skill in the art will recognize that the doubly curved surface 100 is representative of the outline shape of a domed structure.

In order to provide a roofing system for such a domed structure, it is conventional to provide an underlying support structure, and then clad the underlying support structure with a number of roofing panels 110*a* and 110*b*. Such conventional roofing panels, 110*a* and 110*b*, typically consist of long rectangular panels. When such panels, 110*a* and 110*b*, are placed on a doubly curved surface 100, a variable gap, G, results between the adjacent ends of the panels, 110*a* and 110*b*.

For a doubly curved surface having positive gaussian curvature, if the ends of the panels, 110*a* and 110*b*, are positioned in contact, the gap between the panels, 110*a* and 110*b*, increases in size towards the middle portion of the panels, 110*a* and 110*b*. Conversely, for a doubly curved surface having negative gaussian curvature, if the centers of adjacent side of the panels, 110*a* and 110*b*, are positioned in contact, the gap between the panels, 110*a* and 110*b*, increases in size towards the end portions of the panels, 110*a* and 110*b*.

Figure 3:
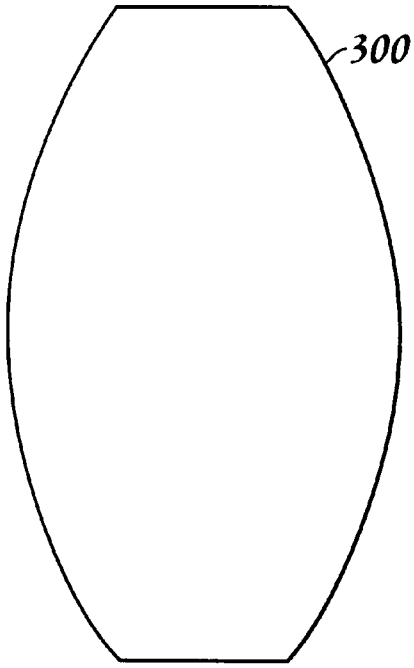
Fig. 3 (PRIOR ART)
FIG. 3 is a top view illustrating an embodiment of a panel for bridging the gap between adjacent rectangular panels on a doubly curved surface having positive curvature.
Figure 4:
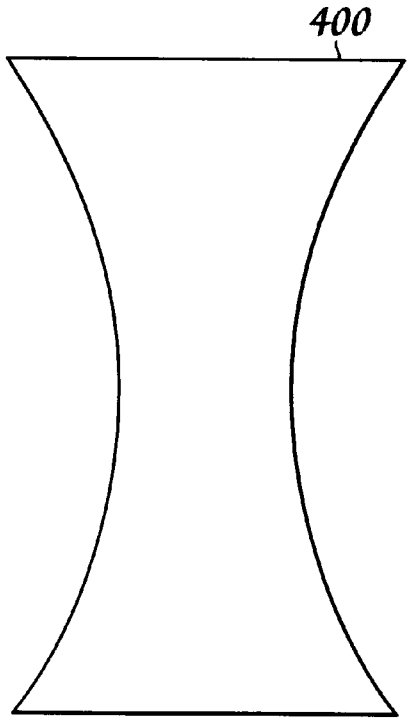
Fig. 4 (PRIOR ART)
FIG. 4 is a top view illustrating an embodiment of a panel for bridging the gap between adjacent rectangular panels on a doubly curved surface having negative curvature.

Referring to FIGS. 3 and 4, one conventional method for bridging the gap, G, between adjacent roofing panels, 110*a* and 110*b*, on a doubly curved surface includes the use of custom made roofing panels, 300 and 400. The custom roofing panel 300 is adapted to bridge the variable gap between adjacent roofing panels on a doubly curved surface having positive gaussian curvature. The custom roofing panel 400 is adapted to bridge the variable gap between adjacent roofing panels on a doubly curved surface having negative gaussian curvature. The design and construction of such custom made roofing panels is expensive and time consuming. Persons of ordinary skill in the art will recognize that many other shapes and sizes of custom made roofing panels can be used to bridge such gaps.

Figure 5:
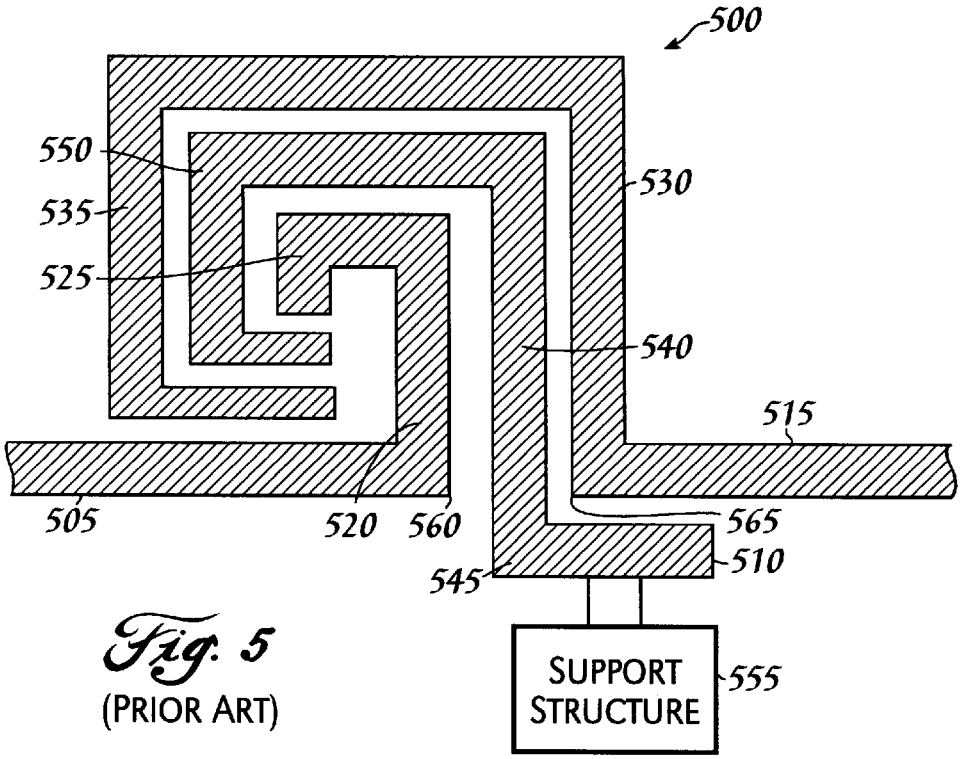
Fig. 5 (PRIOR ART)
FIG. 5 is a cross sectional illustration of a prior art cladding.
Figure 6:
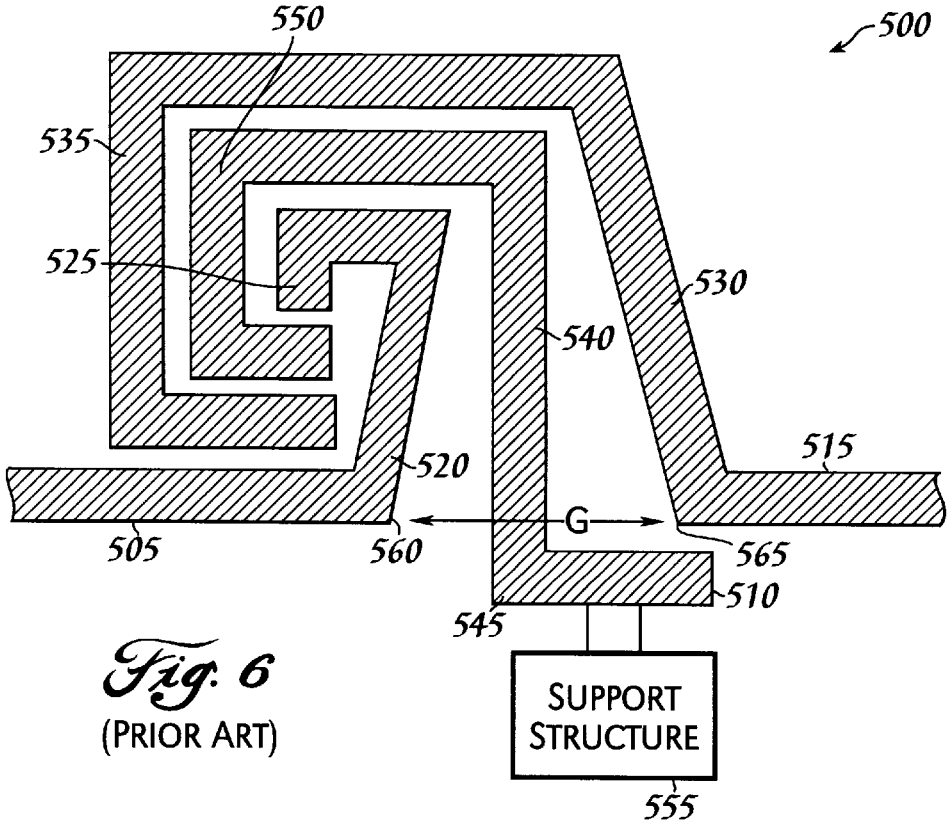
Fig. 6 (PRIOR ART)
FIG. 6 is a cross sectional illustration of a prior art cladding for bridging a gap between adjacent panels.

Referring to FIGS. 5 and 6, another conventional approach to preventing gaps between cladding panels in the application of cladding panels onto doubly curved surfaces is to use an intermediate fixed member, often referred to as a clip, between the cladding panels to distort the cladding panels to thereby bridge the gap. As illustrated in FIG. 5, a conventional cladding 500 includes a first cladding panel 505, a clip 510, and a second cladding panel 515.

The first cladding panel 505 includes a standing seam member 520. The standing seam 520 includes a hook 525. The second cladding panel 515 includes a standing seam member 530. The standing seam member 530 includes a hook 535. The clip 510 includes a standing seam member 540 and a base member 545. The standing seam member 540 includes a hook 550. The base member 545 of the clip 510 is mounted onto an underlying supporting structure (not illustrated).

The standing seam member 530 of the second cladding panel 515 overlaps and mates with the standing seam member 540 for the clip 510. The standing seam member 540 for the clip 510 overlaps and mates with the standing seam member 520 for the first cladding panel 505. The interaction of the hook 525 of the first cladding panel 505 with the hook 550 of the clip 510 prevents lateral movement of the hook 525 of the first cladding panel 505 relative to the hook 550 of the clip 510. In similar fashion, the interaction of the hook 535 of the second cladding panel 515 with the hook 550 of the clip 510 prevents lateral movement of the hook 535 of the second cladding panel 515 relative to the hook 550 of the clip 510.

When the conventional cladding 500 is mounted onto a doubly curved surface, the clip 510 is affixed to the underlying support structure 555 at a position proximate to the location where the gap would normally exist between the opposing edges 560 and 565 of the cladding panels 505 and 515, respectively. The cladding panels 505 and 515 are then mounted onto the doubly curved surface using the standing seam member 540 of the clip 510 to distort the standing seam members 520 and 530 of the cladding panels 505 and 515, respectively. In particular, the standing seam members 520 and 530 of the cladding panels 505 and 515 are displaced from a substantially vertical orientation by their overlapping and hooked relationship with the standing seam member 540 of the clip 510. In this manner, the gap G between the opposing edges 560 and 565 of the cladding panels 505 and 515 is bridged by the displacement of the standing seam members 520 and 530.

One limitation of the conventional approach to bridging the gap between adjacent cladding panels illustrated in FIGS. 5 and 6 is the need to accommodate the vertical displacement of the standing seam members 520 and 530 of the cladding panels 505 and 515. In particular, when the standing seam members 520 and 530 are displaced in a horizontal direction in order to bridge the gap G, the vertical height of the standing seam members 520 and 530 are reduced.

Figure 7:
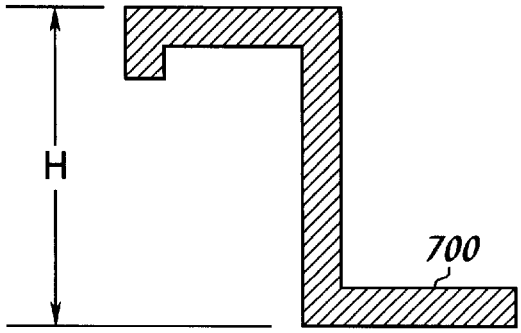
FIG. 7 is a cross sectional illustration of an embodiment for a clip for use in cladding for use in bridging a gap.
Figure 8:
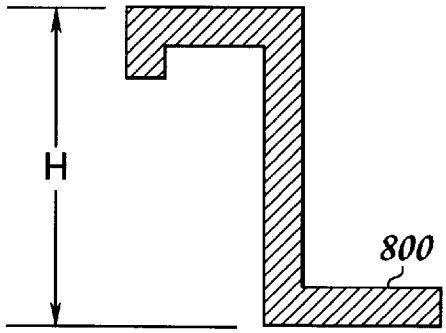
FIG. 8 is a cross sectional illustration of an embodiment of the height adjustment of a clip for use in cladding for bridging a gap.
Figure 9:
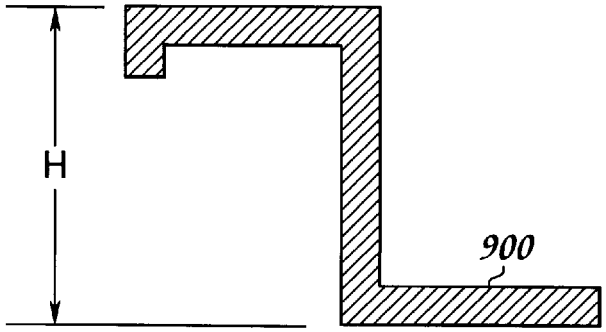
FIG. 9 is a cross sectional illustration of another embodiment of the height adjustment of a clip for use in bridging a gap.

As illustrated in FIGS. 7, 8 and 9, in a preferred embodiment, in order to accommodate the vertical displacement of the standing seam members 520 and 530 of the cladding panels 505 and 515 created by bridging the gap G, a supply of variable sized clips 700, 800, and 900 are provided at the construction site with various vertical heights H. In this manner, the optimum fit can be obtained in the interface between the cladding panels 505 and 515 and the clips. In an alternative preferred embodiment, a supply of clip 700 are provided at the construction site which can be modified to provide the clips 800 and 900.

Figure 10:
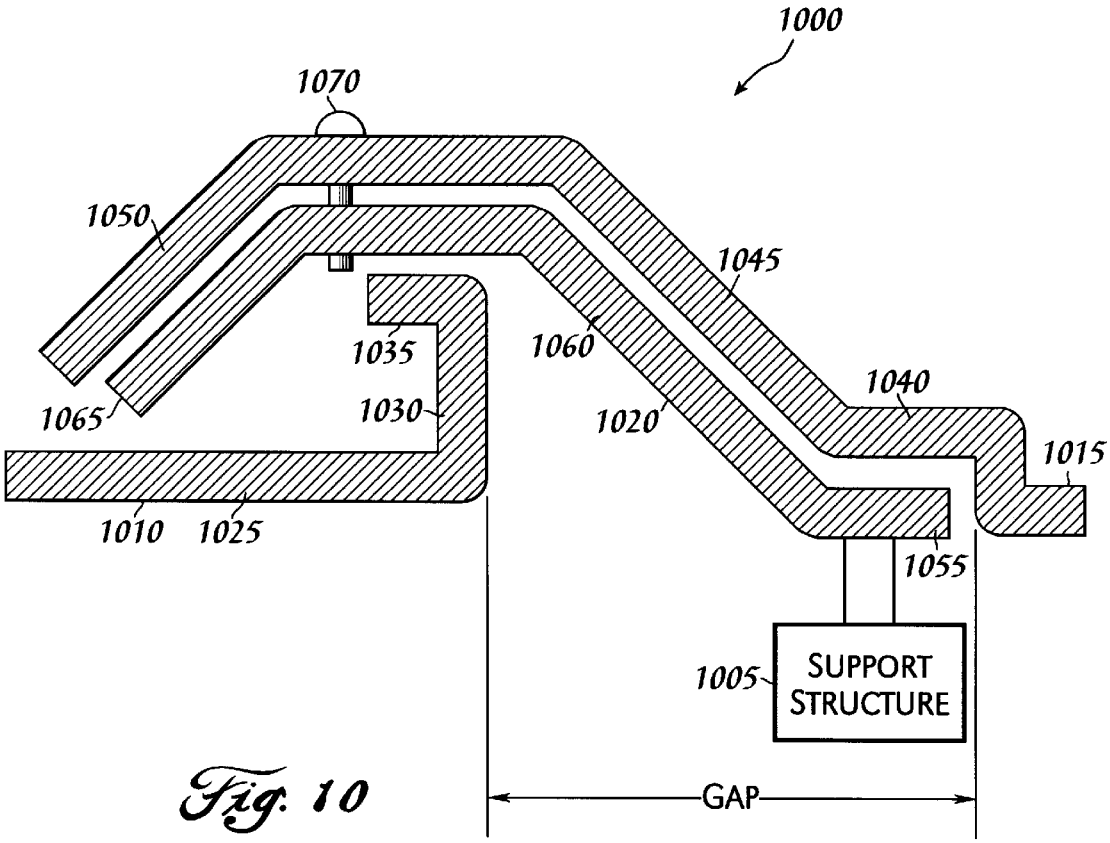
FIG. 10 is a cross sectional illustration of an embodiment of a cladding system for use in bridging a gap.

Referring to FIG. 10, an alternative preferred embodiment of a cladding system 1000 for bridging the gap between adjacent cladding panels in a roofing system for a building includes a support structure 1005, a first cladding panel 1010, a second cladding panel 1015, and a clip 1020. The support structure 1005 may comprise any number of conventional commercially available support structures. In a preferred embodiment, the support structure 1005 is any one of the commercially available space frame structures from Geometrica, Inc. in Houston, Tex. Such space frame structures are particularly suited to large free span structures.

The first cladding panel 1010 includes a plane member 1025 and a seam member 1030. The seam member 1030 preferably extends from the plane member 1025 in a substantially vertical direction relative to the plane of the plane member 1025. The seam member 1030 includes a hook member 1035. In a preferred embodiment, the seam member 1030 extends from the plane member 1025 in a substantially perpendicular direction. In an alternative preferred embodiment, the outline of the cross sectional shape of the seam member 1030 is approximately trapezoidal. The first cladding panel 1010 may be fabricated, for example, from aluminum or galvanized sheet metal using conventional methods. The width and thickness of the first cladding panel 1010 are preferably substantially constant throughout.

The second cladding panel 1015 includes a plane member 1040 and a seam member 1045. The seam member 1045 preferably extends from the plane member 1040 in a substantially vertical direction relative to the plane of the plane member 1040. The seam member 1045 includes a hook member 1050. In a preferred embodiment, the outline of the cross sectional shape of the seam member 1045 is approximately trapezoidal. In an alternative embodiment, the outline of the cross sectional shape of the seam member 1045 is approximately rectangular. The second cladding panel

1015 may be fabricated, for example, from aluminum or galvanized sheet metal using conventional methods.

The clip 1020 includes a plane member 1055 and a seam member 1060. The seam member 1060 preferably extends from the plane of the plane member 1055 in a substantially vertical direction relative to the plane of the plane member 1055. The plane member 1055 is preferably coupled to the support structure 1005 using conventional mechanical fasteners. The seam member 1060 includes a hook member 1065. In a preferred embodiment, the outline of the cross sectional shape of the seam member 1060 is approximately trapezoidal. In an alternative embodiment, the outline of the cross sectional shape of the seam member 1060 is approximately rectangular. The clip 1020 may be fabricated, for example, from aluminum or galvanized sheet metal using conventional methods. The width and thickness of the clip 1020 are preferably substantially constant throughout.

In a particularly preferred embodiment, the outline of the cross sectional shapes of the seam members, 1030, 1045, and 1060, of the first cladding panel 1010, second cladding panel 1015, and clip 1020 are rectangular, approximately trapezoidal, and approximately trapezoidal, respectively. In this manner, the clip 1020 nests within the second cladding panel 1015 and the position of the first cladding panel 1010 within the clip 1020 can be varied to accommodate variations in the gap G between the cladding panels 1010 and 1015. In a particularly preferred embodiment, the shape of the second cladding panel 1015 is further modified to closely match with the outer surface shape of the clip 1020. In this manner, a close mating relationship is obtained between the second cladding panel 1015 and the clip 1020.

In a preferred embodiment, a conventional mechanical fastener 1070 is used to rigidly couple the second cladding panel 1015 and the clip 1020.

Figure 11:
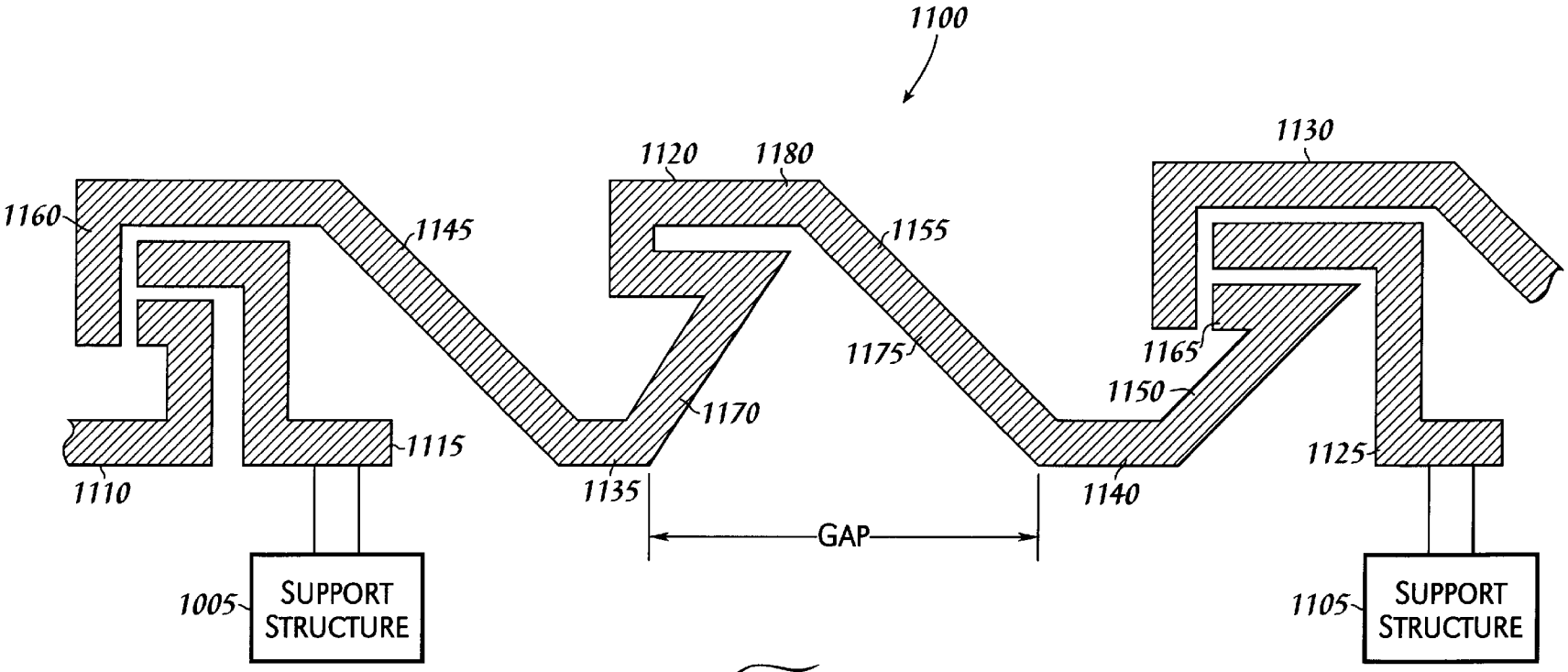
FIG. 11 is a cross sectional illustration of an embodiment of a cladding system for use in bridging a gap.

Referring to FIG. 11, an alternative preferred embodiment of a cladding system 1100 for bridging a gap between roofing panels in a roofing system for a building includes a support structure 1105, a first roofing panel 1110, a first clip 1115, a bridging panel 1120, a second clip 1125, and a second roofing panel 1130. The support structure 1105 may comprise any number of conventional commercially available support structures. In a preferred embodiment, the support structure 1105 is any one of the commercially available space frame structures from Geometrica, Inc. in Houston, Tex. Such space frame structures are particularly suited to large free span structures.

The first roofing panel 1110, first clip 1115, second clip 1125, and second roofing panel 1130 may comprise conventional roofing panels and clips. Alternatively, or in combination, the first roofing panels 1110 and/or the second roofing panel 1130 may comprise bridging panels 1120.

The bridging panel 1120 preferably includes a first plane member 1135, a second plane member 1140, a first vertical seam member 1145, a second vertical seam member 1150, and an adjustable member 1155. The vertical seam members 1145 and 1150 are preferably adapted for coupling to the roofing clips 1115 and 1125 and/or the other cladding panels 1110 and 1130. In this manner, the bridging panel 1120 alone or in combination with other cladding panels forms a roofing structure for a building. The adjustable member 1155 is preferably adapted to permit the gap G between the plane members 1135 and 1140 to vary. In this manner, the bridging panel 2005 permits a roofing structure to accommodate variations in the underlying surface structure. In a particularly preferred embodiment, the bridging panel 1120 is used to provide a roofing structure for doubly curved surfaces.

The seam members 1145 and 1150 preferably extend from the plane members 1135 and 1140 in substantially vertical directions relative to the planes of the plane members 1135 and 1140. The seam members 1145 and 1150 include hook members 1160 and 1165. In a preferred embodiment, the outlines of the cross sectional shapes of the seam members 1145 and 1150 are approximately trapezoidal and rectangular, respectively. In an alternative preferred embodiment, the outlines of the cross sectional shapes of the seam members 1145 and 1150 are approximately rectangular and trapezoidal, respectively. In other alternative embodiments, the outlines of the seam members 1145 and 1150 are both approximately rectangular, or both trapezoidal.

The adjustable member 1155 preferably includes a first seam member 1170, a second seam member 1175, and a bridge member 1180. The seam members 1170 and 1175 preferably extend from the plane members 1135 and 1140 in substantially vertical directions relative to the planes of the plane members 1135 and 1140. In a particularly preferred embodiment, the seam members 1170 and 1175 are inclined in opposing directions from the vertical direction. The bridge member 1180 extends between the seam members 1170 and 1175. In a preferred embodiment, the bridge member 1180 is substantially parallel to the plane of the plane members 1135 and 1140. In a preferred embodiment, the outline of the cross sectional shape of the adjustable member 1155 is approximately trapezoidal. In alternative embodiments, the outline of the cross sectional shape of the adjustable member 1155 is approximately rectangular or triangular.

In this manner, the adjustable member 1155 bridges the gap G between the plane members 1135 and 1140 regardless of variations in the gap G between the plane members 1135 and 1140. In particular, when used in a roofing system for a building structure, the positions of the seam members 1170 and 1175 of the adjustable member 1155 will be deformed to adjust for variations in the gap G between the plane members 1135 and 1140.

The bridging panel 1120 may be fabricated, for example, from aluminum or galvanized sheet metal using conventional methods. The thickness and width of the bridging panel 1120, as fabricated, are preferably substantially constant throughout.

Figure 12:
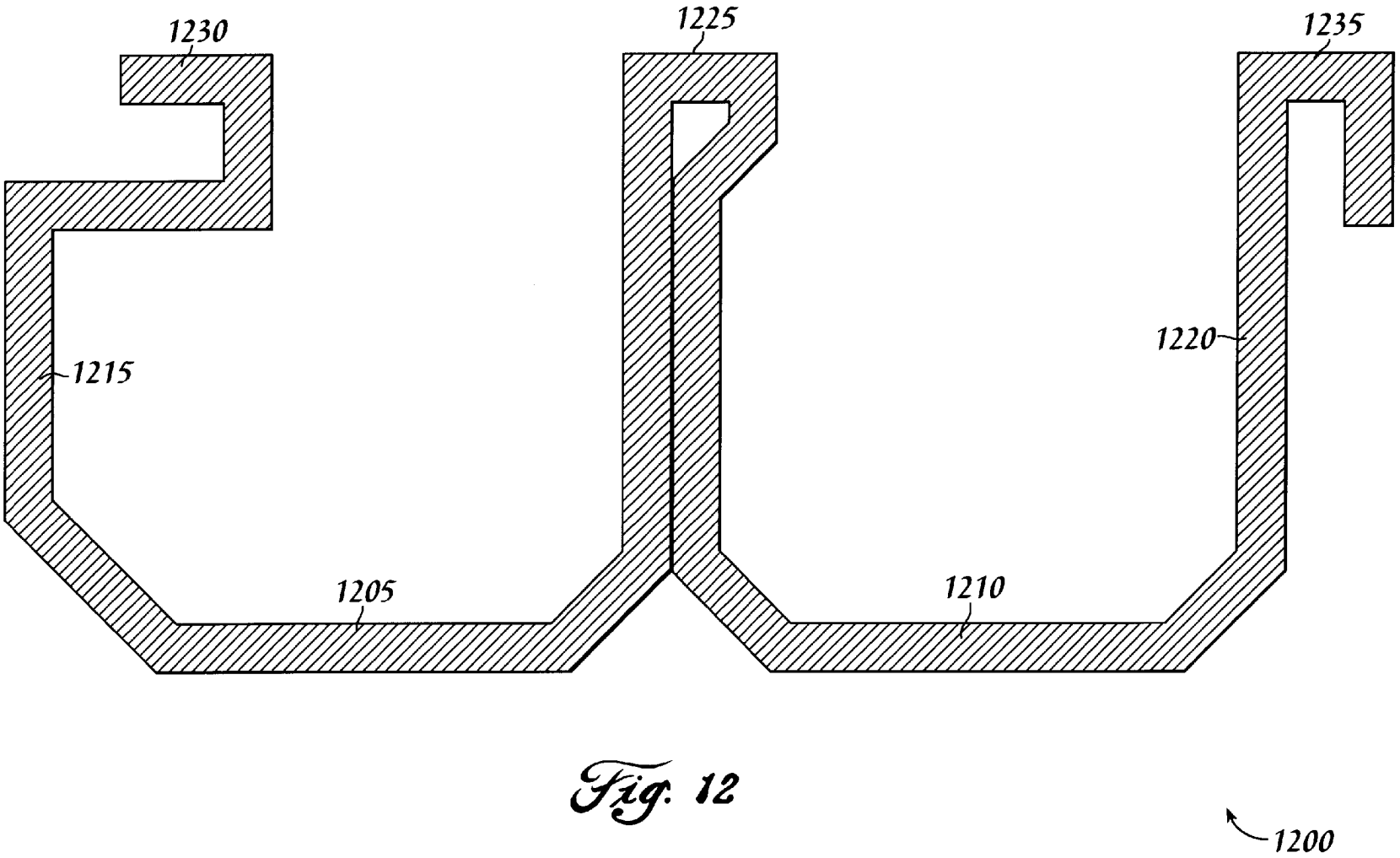
FIG. 12 is a cross sectional illustration of a preferred embodiment of the cladding system of FIG. 11.

In a particularly preferred embodiment, as illustrated in FIG. 12, the bridging panel 1200 includes a first plane member 1205, a second plane member 1210, a first vertical seam member 1215, a second vertical seam member 1220, and an adjustable member 1225. In a preferred embodiment, the first plane member 1205 has a length of approximately 8.1 inches, the second plane member 1210 has a length of approximately 8.010 inches, and the first and second plane members, 1205 and 1210, are separated by a gap of approximately 2.063 inches. In a particularly preferred embodiment, the seam members 1215 and 1220 extend approximately 2.5 inches above the plane members 2010 and 2012. In the particularly preferred embodiment, the seam members 1215 and 1220 include inclined sections that begin approximately 1 inch from the end of the bridging panel 1200.

The seam members 1215 and 1220 further include hook members 1230 and 1235. The hook members 1230 and 1235 of the seam members 1215 and 1220 are preferably approximately 0.625 inches and 0.75 inches in length respectively.

Figure 13:
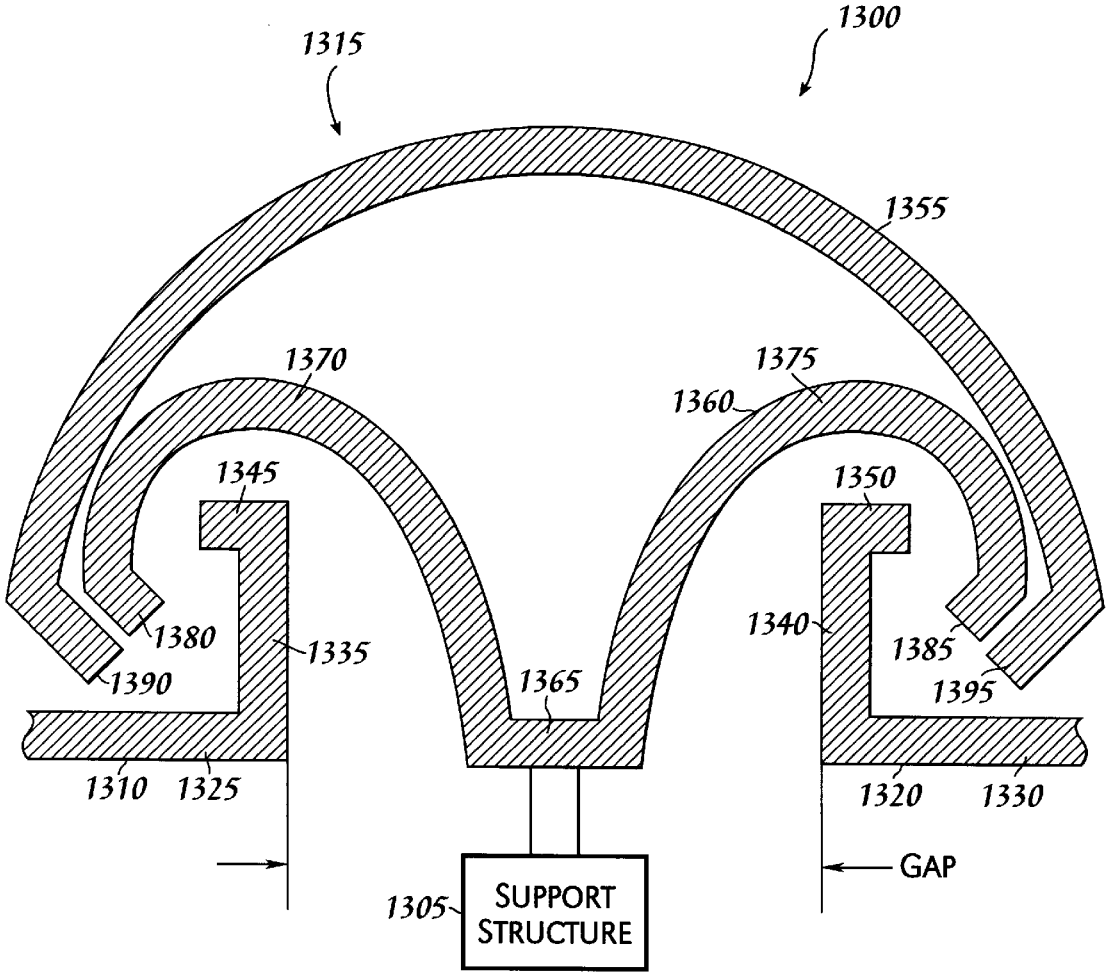
FIG. 13 is a cross sectional illustration of an embodiment of a cladding system for use in bridging a gap.

Referring to FIG. 13, an alternative preferred embodiment of a cladding system 1300 for bridging the gap between adjacent roofing panels in a roofing system for a building includes a support structure 1305, a first cladding panel 1310, a bridge 1315, and a second cladding panel 1320. The support structure 1305 may comprise any number of commercially available support structures. In a preferred embodiment, the support structure 1305 is any one of the commercially available space frame structures from Geometrica, Inc. in Houston, Tex. Such space frame structures are particularly suited to large free span structures.

The cladding panels 1310 and 1320 may comprise conventional cladding panels. In a preferred embodiment, the cladding panels 1310 and 1320 include plane members 1325 and 1330 and seam members 1335 and 1340, respectively. The seam members 1335 and 1340 preferably extend from the plane members 1325 and 1330 in a substantially vertical direction relative to the planes of the plane members 1325 and 1330. In a particularly preferred embodiment, the seam members 1335 and 1340 include hook members 1345 and 1350. In a preferred embodiment, the outline of the cross sectional shapes of the seam members 1335 and 1340 are approximately rectangular. In an alternative embodiment, the outline of the cross sectional shapes of the seam members 1335 and 1340 are approximately trapezoidal. The cladding panels 1310 and 1320 may be fabricated, for example, from galvanized sheet metal using conventional methods. The width and thickness of the cladding panels 1310 and 1320 are preferably substantially constant throughout.

The bridge 1315 includes a cover 1355 and a clip 1360 that are adapted to bridge the gap G between the plane members 1325 and 1330 of the cladding panels 1310 and 1320.

The clip 1360 includes a plane member 1365 and seam members 1370 and 1375. The seam members 1370 and 1375 preferably extend from the plane member 1365 in a substantially vertical direction relative to the plane of the plane member 1365. The plane member 1365 is preferably coupled to the support structure 1305 using conventional mechanical fasteners. The seam members 1370 and 1375 preferably include hook members 1380 and 1385. In a preferred embodiment, the outline of the cross sectional shapes of the seam members 1370 and 1375 are approximately trapezoidal. In an alternative embodiment, the outline of the cross sectional shapes of the seam members 1370 and 1375 are approximately rectangular. The clip 1360 may be fabricated, for example, from aluminum or galvanized sheet metal using conventional methods. The width and thickness of the clip 1360 are preferably substantially constant throughout.

The cover 1365 is preferably comprised of an arcuate section and is adapted to fit over the clip 1360. The cover 1365 preferably includes hooks 1390 and 1395 that permit the cover 1355 to be locked onto the clip 1360. The cover 1355 may be fabricated, for example, from aluminum or galvanized sheet metal using conventional methods. The width and thickness of the cover 1355 are preferably substantially constant throughout.

The outline of the cross sectional shapes of the seam members 1335 and 1340 of the cladding panels 1310 and 1320 and the seam members 1370 and 1375 of the clip 1360 are preferably selected to be approximately trapezoidal and approximately rectangular, respectively. In this manner, the bridge 1315 is able to accommodate variations in the gap G between the plane members 1325 and 1330 of the cladding panels 1310 and 1320.

Figure 14:
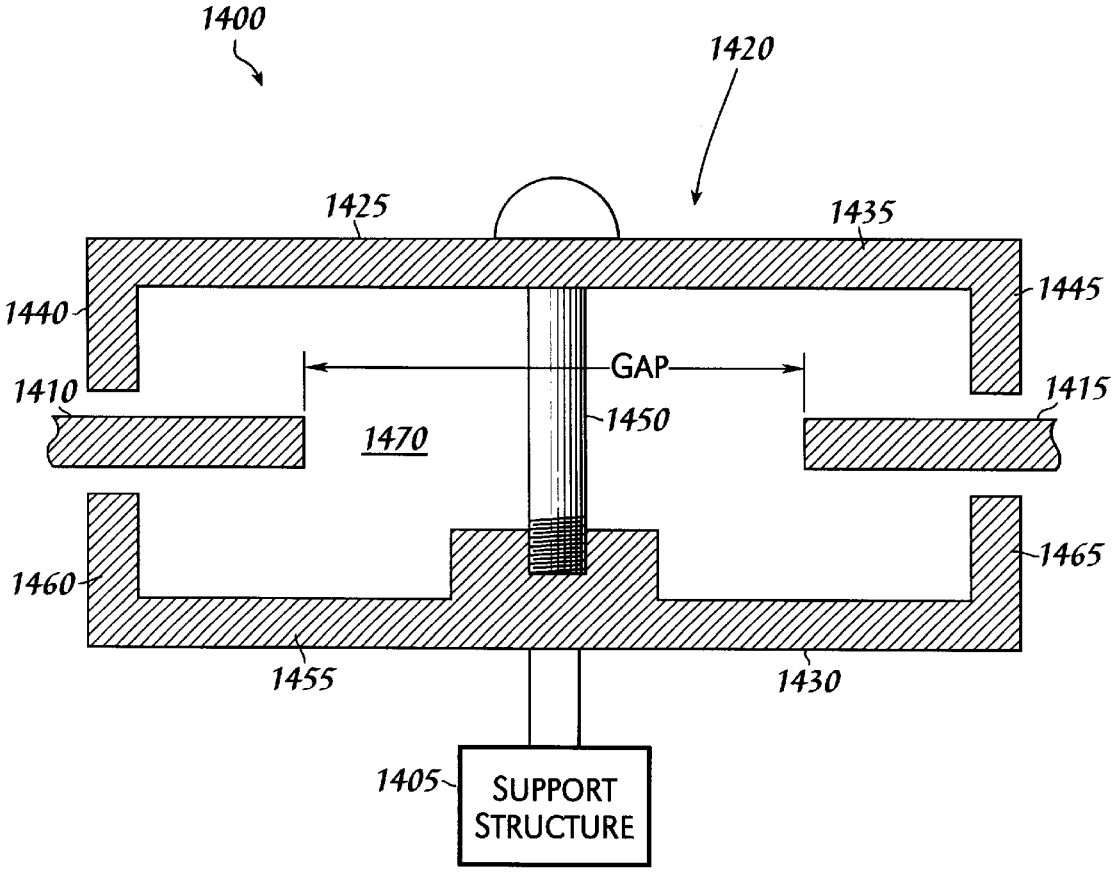
FIG. 14 is a cross sectional illustration of an embodiment of a cladding system for use in bridging a gap.

Referring to FIG. 14, an alternative preferred embodiment of a cladding system 1400 for bridging the gap between adjacent roofing panels in a roofing system for a building includes a support structure 1405, a first cladding panel 1410, a second cladding panel 1415, and a bridge 1420. The support structure 1405 may comprise any number of commercially available support structures. In a preferred embodiment, the support structure 1405 is any one of the commercially available space frame structures from Geometrica, Inc. in Houston, Tex. Such space frame structures are particularly suited to large free span structures.

The cladding panels 1410 and 1415 may comprise conventional cladding panels suitable for use in a roofing system for a building. In a preferred embodiment, the cladding panels 1410 and 1415 comprise any one of the embodiments of the cladding panels disclosed in the present disclosure.

The bridge 1420 is adapted to bridge the gap G between the plane members of the cladding panels 1410 and 1415. In a preferred embodiment, the bridge 1420 includes a top member 1425 and a bottom member 1430.

The top member 1425 includes a plane member 1435 and seam members 1440 and 1445. The seam members 1440 and 1445 extend from the plane member 1435 in a vertical direction. In a preferred embodiment, the seam members 1440 and 1445 extend from the plane member 1435 in a substantially perpendicular direction. In a preferred embodiment, the plane member 1435 is substantially parallel to the plane of the plane members of the cladding panels 1410 and 1415. The plane member 1435 is coupled to the bottom member 1430 using a conventional mechanical fastener 1450. The top member 1425 may be fabricated, for example, from aluminum or galvanized sheet metal using conventional methods. In a preferred embodiment, the width and thickness of the top member 1425 are substantially constant.

The bottom member 1430 includes a plane member 1455 and seam members 1460 and 1465. The seam members 1460 and 1465 extend from the plane member 1455 in a vertical direction. In a preferred embodiment, the seam members 1460 and 1465 extend from the plane member 1455 in a substantially perpendicular direction. In a preferred embodiment, the plane member 1455 is substantially parallel to the plane of the plane members of the cladding panels 1410 and 1415. The plane member 1455 is preferably coupled to the support structure 1405 using the conventional mechanical fastener 1450. The bottom member 1430 may be fabricated, for example, from aluminum or galvanized sheet metal using conventional methods. In a preferred embodiment, the width and thickness of the top member 1430 are substantially constant.

In a particularly preferred embodiment, the top and bottom members 1425 and 1430 provide a cavity 1470 into which the edge portions of the cladding panel 1410 and 1415 project. In this manner, the bridge 1420 bridges the gap G between the plane members of the cladding panels 1410 and 1415. Furthermore, the bridge 1420 is able to accommodate variations in the gap G between the plane members of the cladding panels 1410 and 1415.

Figure 15:
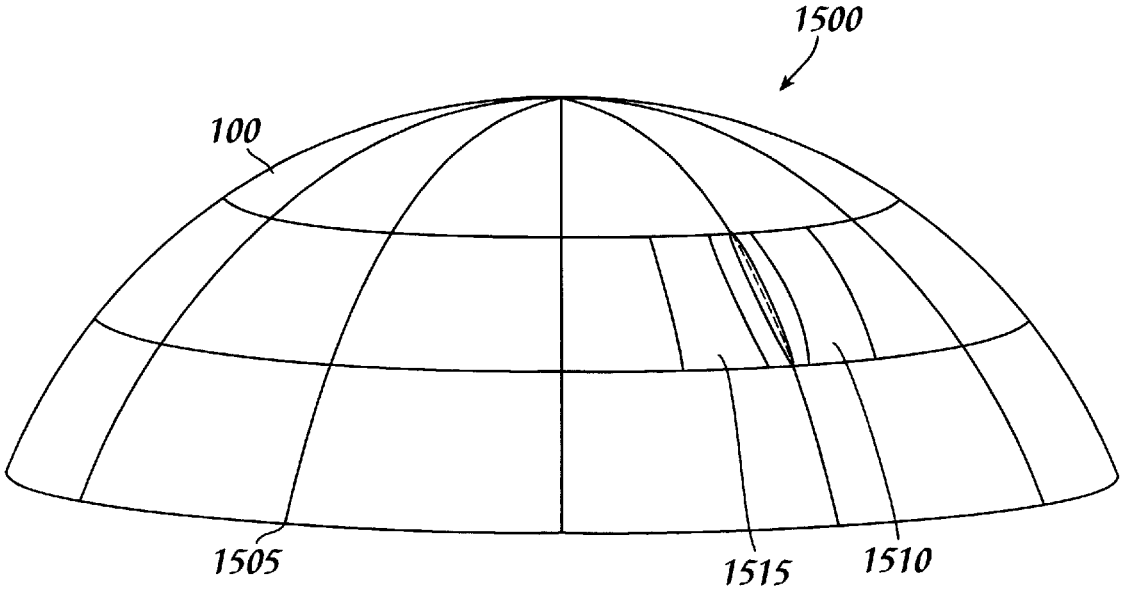
FIG. 15 is an illustration of another embodiment of a cladding system that eliminates gaps by overlapping adjacent panels.
Figure 16:
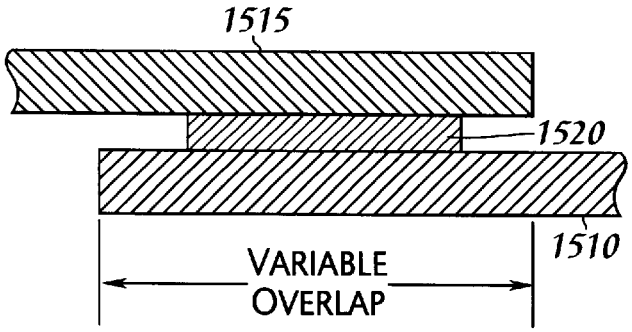
FIG. 16 is a cross-sectional illustration of the embodiment of the cladding system for use in overlapping adjacent panels of FIG. 15.

Referring to FIGS. 15 and 16, an alternative preferred embodiment of a cladding system 1500 for bridging the gap between adjacent roofing panels in a roofing system for a building includes a support structure 1505, a first roofing panels 1510, and a second roofing panel 1515. The support structure 1505 may comprise any number of commercially available support structures. In a preferred embodiment, the support structure 1505 is any one of the commercially available space frame structures from Geometrica, Inc. in Houston, Tex. Such space frame structures are particularly suited to large free span structures.

The cladding panels 1510 and 1515 may comprise conventional cladding panels suitable for use in a roofing system for a building. In a preferred embodiment, the cladding panels 1510 and 1515 comprise substantially rectangular roofing panels comprised of a fabric, rubber, or other flexible member. The cladding panels 1510 and 1515 are preferably arranged in an overlapping arrangement.

As illustrated in FIG. 16, in a preferred embodiment, the cladding panels 1510 and 1515 are preferably coupled in the overlap using an adhesive material 1520. In this manner, a watertight roofing structure is provided. The adhesive material 1520 may comprise any number of conventional commercially available adhesive materials such as, for example, epoxy, tar other suitable adhesive material for roofing materials.

The roofing system 1500 is especially useful in providing a watertight roofing system for a domed structure. The roofing system 1500 eliminates the need to provide expensive custom fit roofing panels. In this manner, the roofing system 1500 greatly reduces the cost of construction of such buildings.

As illustrated in FIG. 16, as the gap between adjacent roofing panels is prevented by the overlap, the overlap between adjacent roofing panels reaches a maximum at the ends of the adjacent roofing panels for a doubly curved surface having positive gaussian curvature. Conversely, as the gap between adjacent roofing panels is prevented by the overlap, the overlap between adjacent roofing panels reaches a minimum at the ends of the adjacent roofing panels for a doubly curved surface having negative gaussian curvature.

A building has been described that includes a support structure, a first panel coupled to the support structure, a second panel coupled to the support structure, wherein at least a portion of the second panel is separated from the first panel by a gap, and a clip coupled to the support structure adapted to couple the first and second panels, wherein the extension of the clip above the first and second panels is adjustable. In a preferred embodiment, the first and second panels to be positioned within a doubly curved surface. In a preferred embodiment, the support structure comprises a free span support structure. In a preferred embodiment, the support structure comprises a space frame structure. In a preferred embodiment, the building includes a first panel including a plane member and a seam member extending from the plane member, a second panel including a plane member and a seam member extending from the plane member, and a clip including a plane member and a seam member extending from the plane member, wherein the seam members of the first panel, second panel and clip are positioned in an overlapping relationship. In a preferred embodiment, the plane members of the first panel, second panel and clip that are positioned within a doubly curved surface.

A roofing system for a building has also been disclosed that includes a first panel, and a second panel, wherein at least a portion of the second panel is separated from the first panel by a gap, and a clip adapted to couple the first and second panels, wherein the extension of the clip above the first and second panels the first and second panels is adjustable. In a preferred embodiment, the first and second panels are positioned within a doubly curved surface. In a preferred embodiment, the first panel includes a plane member and a seam member extending from the plane member, wherein the second panel includes a plane member and a seam member extending from the plane member, and the clip includes a plane member and a seam member extending from the plane member, wherein the seam members of the first panel, second panel and clip are positioned in an overlapping relationship. In a preferred embodiment, the plane members of the first panel, second panel and clip are positioned within a doubly curved surface.

A coupling for use in joining sections of a roofing system for a building has been disclosed including a base member; and a seam member extending from the base member adapted to join the sections of the roofing system, wherein the extension of the seam member from the base member is adjustable.

Although illustrative embodiments have been shown and disclosed, a wide range of modification, change and substitution is contemplated in the foregoing disclosure. In some instances, some features of the embodiments may be employed without a corresponding use of the other features. Accordingly, it is appropriate that the appended claims be construed broadly and in a manner consistent with the scope of the embodiments disclosed herein.

What is claimed is:

1. A building, comprising:

a support structure;

a first panel coupled to the support structure;

a second panel coupled to the support structure, wherein at least a portion of the second panel is separated from the first panel by gap;

a first clip and a second clip;

a bridge panel coupled to the support structure and the first and second panel via the first and second clips, wherein the bridge panel bridges the gap;

an end of the first panel extending under the first clip and a first end of the bridge panel extending over the first clip; and a second end of the bridge panel extending under the second clip and an end of the second panel extending over the second clip.

2. The building of claim 1, wherein the first panel includes a plane member and a seam member extending from the plane member of the first panel; wherein the second panel includes a plane member and a seam member extending from the plane member of the second panel; wherein each clip includes a plane member and a pair of seam members extending from the plane member, and wherein the seam members of the first and second panels are nested within the seam members of the respective clip.

3. The building of claim 1, wherein the support structure comprises a free span support structure.

4. The building of claim 1, wherein the support structure comprises a space frame structure.

5. A roofing system for a building, comprising:

a first panel;

a second panel, wherein at least a portion of the second panel is separated from the first panel by a gap;

a first clip and a second clip;

a bridge panel coupled to the first and second panels via the first and second clips, wherein the bridge panel bridges the gap;

an edge of the first panel extending under the first clip and a first edge of the bridge panel extending over the first clip; and a second edge of the bridge panel extending under the second clip and an edge of the second panel extending over the second clip.

6. The roofing system of claim 5, wherein the first panel includes a plane member and a seam member extending from the plane member of the first panel; wherein the second panel includes a plane member and a seam member extending from the plane member of the second panel; wherein each clip includes a plane member and a pair of seam members extending from the plane member, and wherein the seam members of the first and second panels are nested within the seam members of the respective clip.

7. A method of building a roofing system comprising:

providing a support structure;

coupling a first panel to the support structure;

coupling a second panel to the support structure, wherein at least a portion of the second panel is separated from the first panel by a gap;

providing a first clip and a second clip;

coupling a bridge panel to the support structure and the first and second panels via the first and second clips, whereby the bridge bridges the gap;

lapping an end of the first panel under the first clip;

lapping a first end of the bridge panel over the end of the first panel and the first clip;

lapping a second end of the bridge panel under the second clip; and lapping an end of the second panel over the second end of the bridge panel and the second clip.

* * * * *